US006215446B1

(12) United States Patent
Sullivan et al.

(10) Patent No.: US 6,215,446 B1
(45) Date of Patent: Apr. 10, 2001

(54) SNAP-IN ANTENNA

(75) Inventors: Jonathan L. Sullivan; Bradley S. Haussler, both of Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/359,821

(22) Filed: Jul. 23, 1999

(51) Int. Cl.[7] ..... H01Q 1/24
(52) U.S. Cl. ..... 343/702; 343/895
(58) Field of Search ..... 343/702, 895, 343/906, 718, 904, 900

(56) References Cited

U.S. PATENT DOCUMENTS

| | | | | |
|---|---|---|---|---|
| 5,243,355 | * | 9/1993 | Emmert et al. | 343/702 |
| 5,353,036 | * | 10/1994 | Baldry | 343/702 |
| 5,479,178 | | 12/1995 | Ha | 343/702 |
| 5,594,457 | | 1/1997 | Wingo | 343/702 |
| 5,661,495 | | 8/1997 | Saldell | 343/702 |
| 5,852,421 | * | 12/1998 | Maldonado | 343/895 |
| 5,856,808 | * | 1/1999 | Holshouser et al. | 343/895 |
| 5,880,696 | | 3/1999 | Koleda | 343/702 |
| 6,052,089 | * | 4/2000 | Eggleston | 343/895 |
| 6,064,341 | * | 5/2000 | Hassemer | 343/702 |
| 6,075,487 | * | 6/2000 | Ito | 343/702 |

* cited by examiner

*Primary Examiner*—Don Wong
*Assistant Examiner*—Thuy Vinh Tran
(74) *Attorney, Agent, or Firm*—Zarley, McKee, Thomte, Voorhees & Sease; Dennis L. Thomte

(57) ABSTRACT

A snap-in stubby or retractable antenna comprising a plastic snap-in connector which is secured to the upper end of a wireless communication device, such as a cellular telephone. The connector includes an alignment keyway which cooperates with an opening formed in the upper end of the housing of the communications device so that the connector may only be installed in the device in one position so that the contact spring associated therewith will be in engagement with the electrical contact pad of the receiving and transmitting circuitry of the device. A flexible latch is provided on the connector which is deflected inwardly as the connector is installed into the telephone, but which snaps outwardly into engagement with a shoulder in the interior of the communications device to yieldably maintain the connector, and the antenna associated therewith on the handset of the communications device.

21 Claims, 5 Drawing Sheets

SNAP-IN ANTENNA

BACKGROUND OF THE INVENTION

1. Field of the Invention

This invention relates to a snap-in antenna and more particularly to snap-in fixed or retractable antennas which may be easily secured to a wireless communication device such as a cellular telephone and which are easily removed therefrom.

2. Description of the Related Art

Due to the ever-increasing growth in the wireless communications industries, suppliers of portable wireless devices, such as cellular telephone handsets, are constantly seeking ways to improve the value of their product while reducing manufacturing costs. One area of intense price pressure is the antenna. Currently, most antenna designs for wireless devices such as cellular telephones, land mobile radio and other portable devices are one of two types. One type of antenna design is the retractable or collapsible antenna. The radiator of the retractable antenna may be extended from the top of the device housing while in use. The antenna radiator may also be retracted into the housing while in the standby mode. The second major type of antenna design is the fixed antenna wherein the antenna radiator is fixed in the extended position and does not move.

In either of the antenna designs discussed above, they are normally comprised of the following components: (1) a radiating element such as a straight wire whip or a helical wound wire; (2) a threaded metal connector that connects the antenna to the communications device; (3) a flexible cover that covers all exposed components; and (4) other miscellaneous components within the antenna assembly. In addition to that described above, the antennas require a mated threaded connector inside the communications device and some sort of electrical connection between the printed circuit board and the antenna.

SUMMARY OF THE INVENTION

The invention disclosed herein relates to a series of antennas which incorporate a unique way to electrically and mechanically attach the antennas to the wireless device. The antenna is mechanically attached to the wireless device by means of a plastic connector that incorporates a molded-in snap latch feature which snaps over an internal edge in the wireless device housing during installation. The antenna is electrically attached to the wireless device by means of a contact that electrically connects the radiating element (elongated radiator or helical wound) to the conductive pad on the printed circuit board. More particularly, the snap-in connector has upper and lower ends with a central bore extending therethrough with the lower end of the connector being selectively removably snapped-in the opening formed in the upper end of the housing of the device. In one embodiment of the invention, a helical antenna is positioned in the central bore of the connector at the upper end thereof and has a spring contact operatively electrically connected thereto which extends downwardly from the helical antenna through the lower end of the central bore of the connector with the spring contact being in electrical contact with the receiving and transmitting circuitry. In a second embodiment of the invention, an elongated rod antenna extends upwardly from the helical antenna. In another embodiment of the invention, a retractable rod radiator is slidably mounted in the connector and is movable between retracted and extended positions. In yet another embodiment of the invention, an elongated rod antenna is slidably movably mounted in the connector and has a helical antenna positioned at the upper end thereof. In all of the embodiments, the lower end of spring contact is in electrical contact with the contact pad of the receiving and transmitting circuitry of the communications device. Further, in all of the embodiments disclosed herein, the opening in the upper end of the housing includes an alignment keyway with the connector including an alignment key structure which is received in the alignment keyway to properly position the spring contact with respect to the receiving and transmitting circuitry.

It is therefore a principal object of the invention to provide an antenna design that is easier to manufacture than prior art antennas.

A further object of the invention is to provide an antenna design which has fewer components than most prior art antennas.

Yet another object of the invention is to provide an antenna design that is easy to install on the handset of the communications device.

Still another object of the invention is to provide an antenna design which results in reduced manufacturing costs, yet maintains a high degree of reliability and performance.

These and other objects will be apparent to those skilled in the art.

DESCRIPTION OF THE PREFERRED EMBODIMENT

Figure 1:
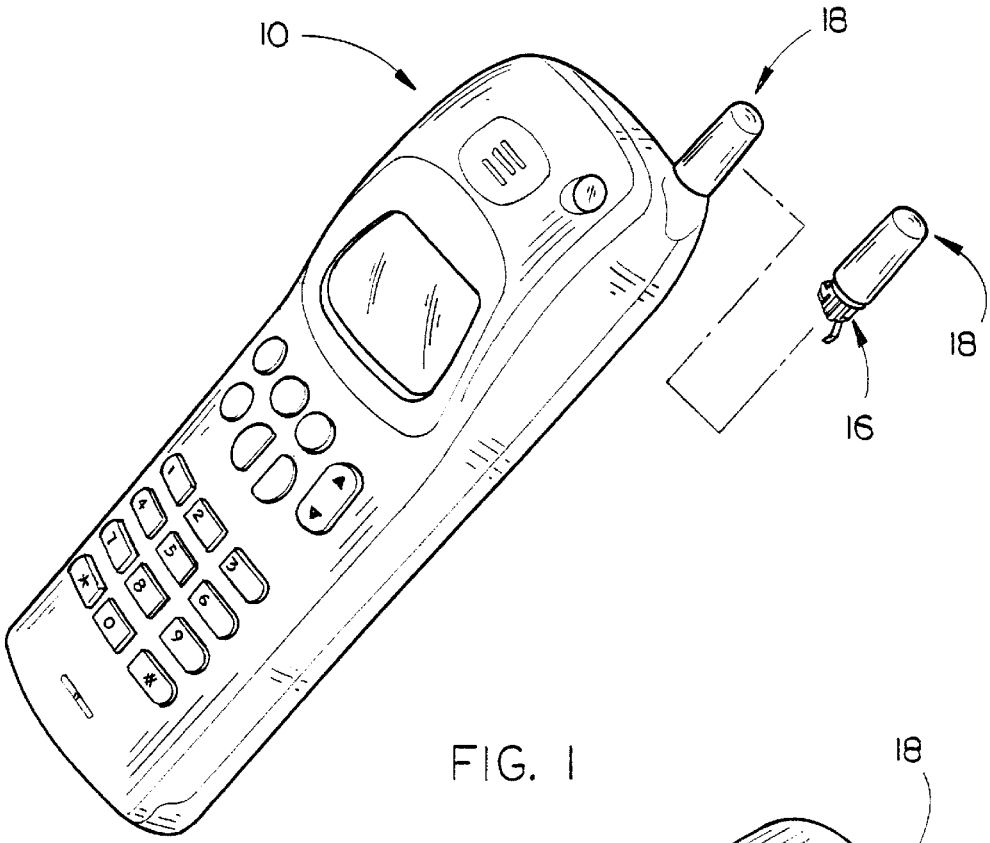
FIG. 1 is a perspective view illustrating a stubby antenna of this invention mounted on the handset of the communications device and removed therefrom.

FIG. 1 illustrates a conventional handset for a wireless communication device such as a cellular telephone and which is designated by the reference numeral 10. Handset 10 is conventional in design except for the opening 12 formed in the upper end of the housing 14. In most cellular telephone handsets, the opening 12 has an electrically conductive threaded connector provided therein which serves as the mounting for the antenna. In this case, the snap-in connector 16 is inserted into the opening 12, as will be described in more detailed hereinafter.

Figure 2:
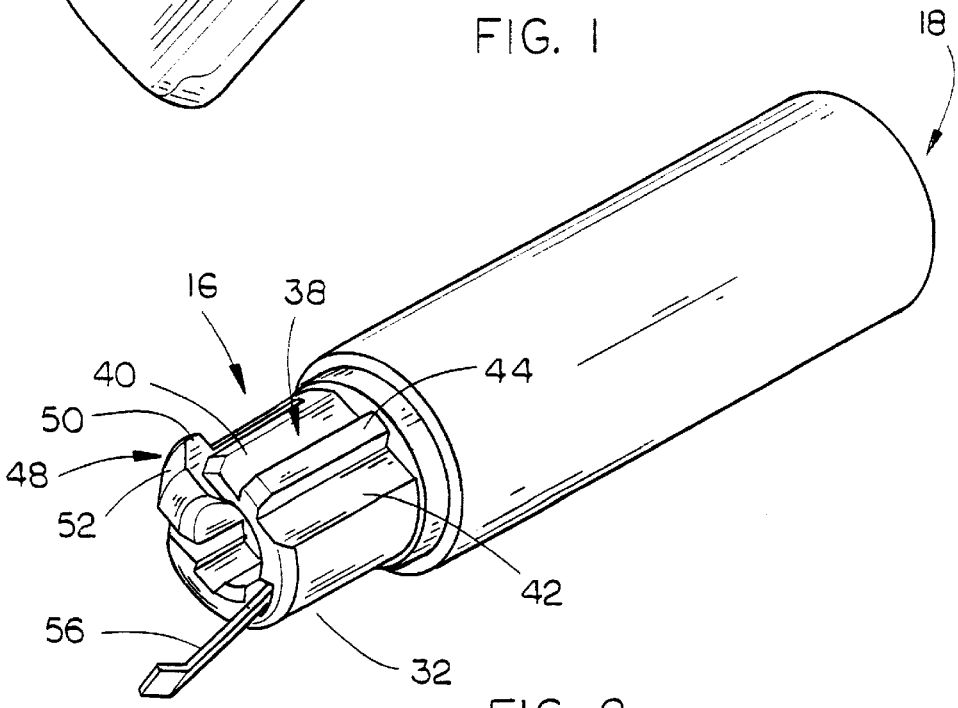
FIG. 2 is a perspective view of the antenna of FIG. 1.

FIGS. 1 and 2 illustrate one form of the embodiment which is commonly referred to as a stubby antenna 18 which is a fixed antenna. The lower end of the stubby antenna 18 is provided with the snap-in connector 16 to enable the antenna 18 to be quickly and easily installed in the opening 12, as will be described in greater detail hereinafter.

Figure 3:
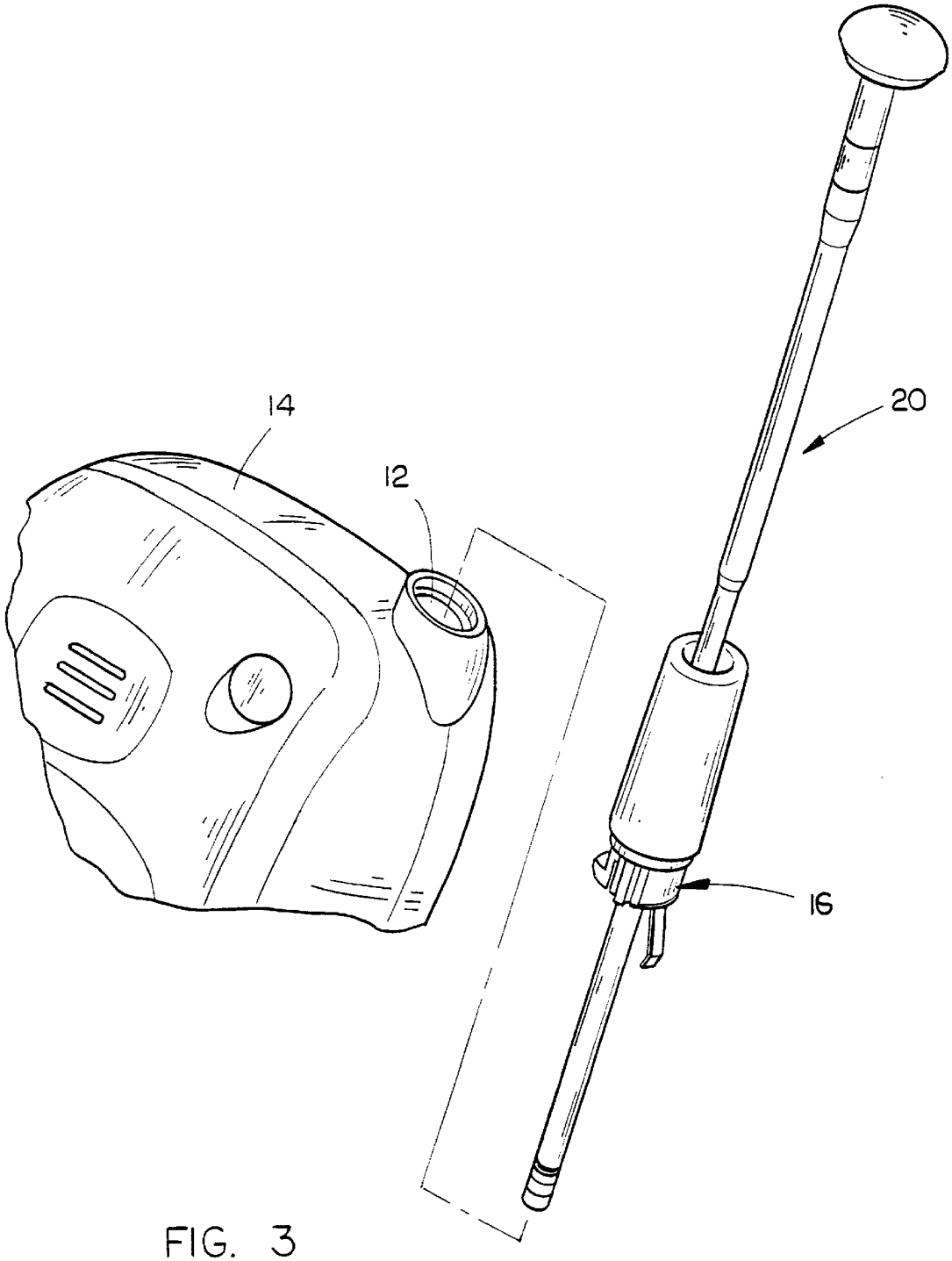
FIG. 3 is a partial exploded perspective view illustrating a retractable antenna having the snap-in connector of this invention included therein.
Figure 5:
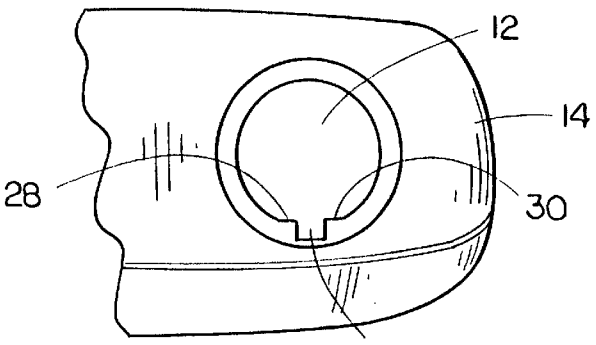
FIG. 5 is a top view of the upper portion of the handset.
Figure 6:
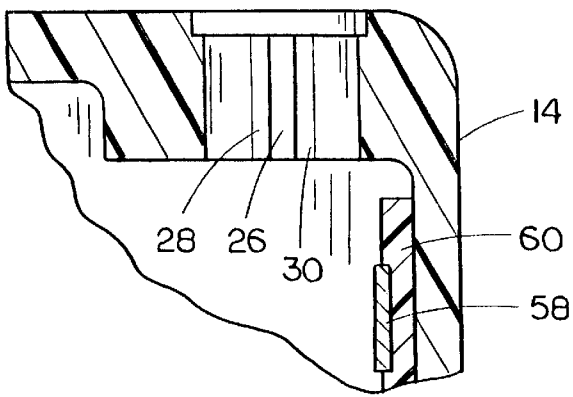
FIG. 6 is a partial vertical view of the upper portion of the handset.
Figure 7:
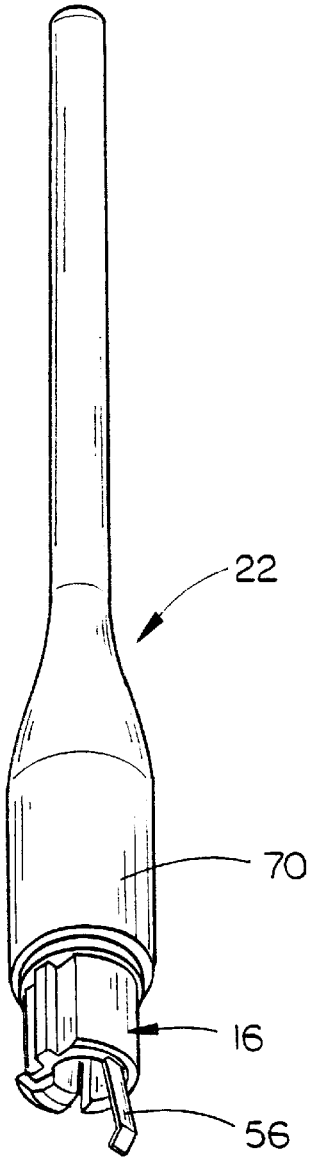
FIG. 7 is a perspective view of an antenna having the snap-in connector of this invention included therein.
Figure 8:
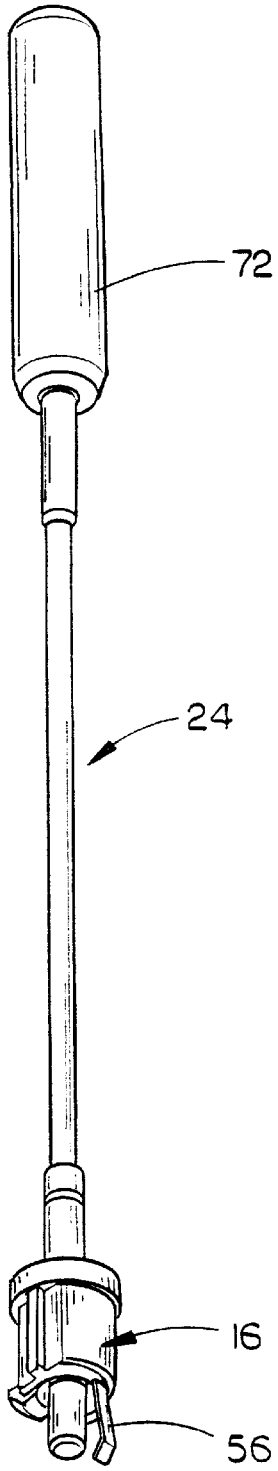
FIG. 8 is a perspective view of a top-loaded retractable antenna having the snap-in connector of this invention included therein.

FIG. 3 illustrates a collapsible or retractable antenna 20 having the snap-in connector 16 included therewith. FIG. 7 illustrates a fixed antenna 22 having the snap-in connector 16 provided at the lower end thereof. In FIG. 8, the numeral 24 refers to a top-loaded retractable antenna having the snap-in connector 16 associated therewith.

To accommodate the snap-in connector 16, the opening 12 in the housing 14 is provided with an alignment keyway 26 which extends laterally outwardly from a pair of flat shoulders 28 and 30 which form a part of the alignment keyway.

Figure 4:
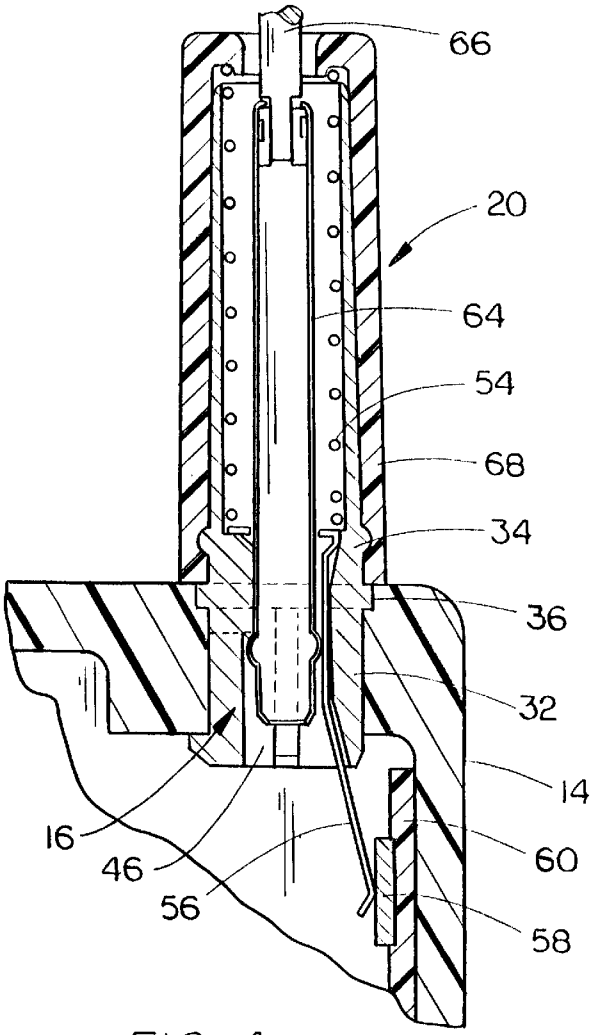
FIG. 4 is a partial vertical view of the antenna and handset of FIG. 3 with the antenna in its extended position.

The construction of the connector 16 is best seen in FIG. 2 and perhaps FIG. 4. Connector 16 includes a lower end portion 32 and an upper end portion 34 which are separated by an annular shoulder 36 which projects outwardly therefrom. Lower end portion 32 is provided with an alignment key structure referred to generally by the reference numeral 38 which includes a pair of flat surfaces 40 and 42 having keyway 44 extending therefrom. Connector 16 also includes a central bore 46 which extends therethrough, as illustrated in FIG. 4. A flexible or resilient latch 48 is provided in the lower end 32 of connector 16 and includes a protruding latching lip 50 having a tapered lower surface 52.

The connector 16 can only be inserted into the opening 12 in one position and that is extremely important in that it is ensured that the spring contact, to be described hereinafter, will be in the proper position with respect to the electrical contact pad of the receiving and transmitting circuitry of the communications device.

The connector 16 is inserted into the opening 12 so that the keyway 44 is received by the keyway 26 with the flat surfaces 40 and 42 being positioned adjacent the flat shoulders 28 and 30, respectively. As the connector 16 is inserted downwardly into the opening 12, the latch 48 is deflected inwardly through the engagement of the tapered surface 52 with the structure surrounding the opening 12 until the latch 50 is able to spring or move outwardly so as to engage an internal surface of the housing 14, as illustrated in FIG. 4.

Figure 9:
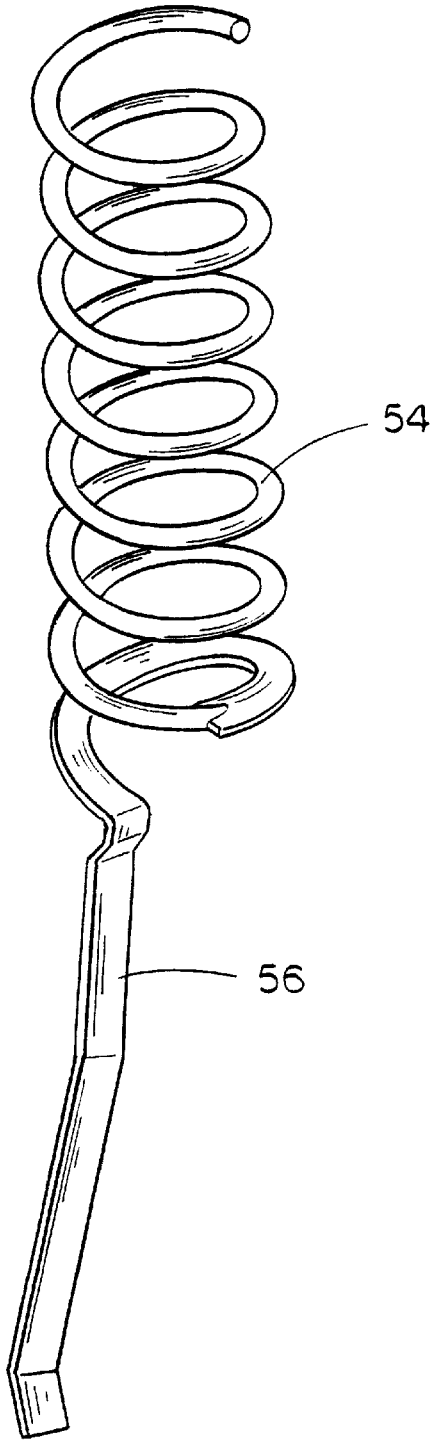
FIG. 9 is a perspective view of one form of the helical radiator employed in the embodiments disclosed herein with a spring contact extended downwardly therefrom.
Figure 10:
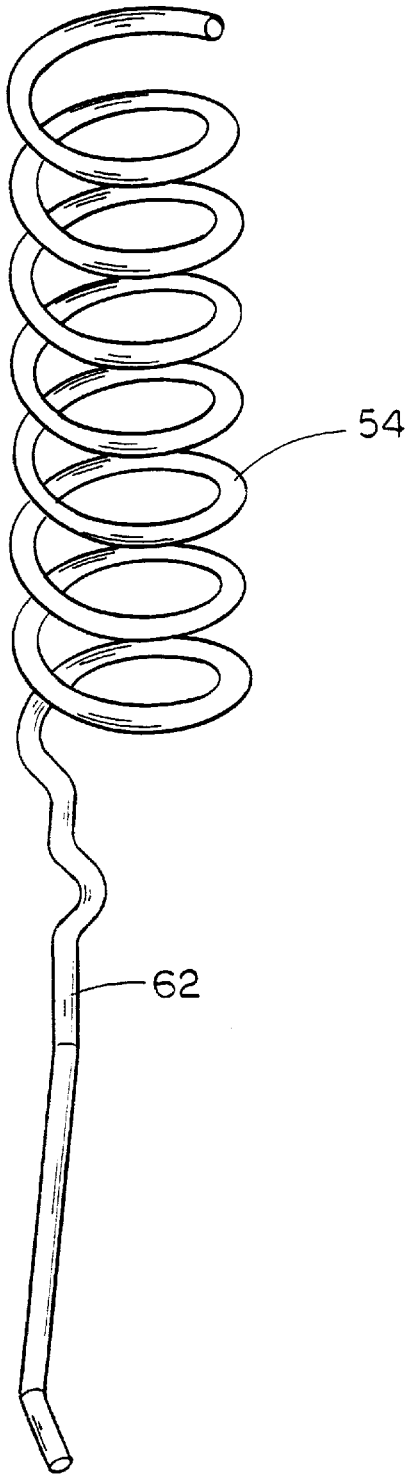
FIG. 10 is a view similar to FIG. 9 except that the spring contact or spring arm is an integral part of the helical antenna.

In the antenna embodiment of FIGS. 3 and 4, a helical radiator 54 is positioned in the upper end of the bore 46 and has a spring contact 56 electrically connected to the lower end thereof. As seen in FIG. 4, the lower end of the spring contact 56 is in electrical contact with the electrical contact pad 58 positioned on the circuit board 60 of the receiving and transmitting circuitry. FIG. 9 illustrates the spring contact 56 being a separate component from the radiator 54. FIG. 10 illustrates that the spring contact is in the form of a leg 62 which an integral part of the helical antenna or radiator 54. In other words, the embodiment of FIG. 10 is of unitary construction while the embodiment of FIG. 9 is of a two-piece construction.

Referring again to the retractable antenna 20 of FIGS. 3 and 4, the numeral 64 refers to an electrically conductive telescopic tube which is secured to the lower end of an elongated rod radiator or antenna 66 which is selectively vertically mounted so as to be able to be moved between a retracted position and an extended position. In the extended position of FIG. 4, the lower end of the tube 64 is in electrical contact with the spring contact 56 so that the radiator 66 is electrically connected to the contact pad 58 through the spring contact 56. The spring contact 56, through its engagement with the tube 64, also serves to yieldably maintain the antenna in its extended position. The upper end of the connector 16 is covered by a conventional coil cover 68.

In the stubby antenna configuration 18 of FIGS. 1 and 2, only a helical radiator is employed which may be either of the design of FIG. 9 or FIG. 10. In the embodiment of FIG. 7, an elongated rod antenna or radiator is secured to a helical radiator positioned within the cover 70 with the helical radiator and rod radiator being connected to the electrical contact pad 58 through the spring contact 56, as previously described.

In the design of FIG. 8, the helical antenna is enclosed within a cover 72 with the helical antenna being positioned at the upper end of the elongated radiator.

Thus, whether the antenna design is of the stubby design of FIGS. 1 and 2, the retractable antenna design of FIG. 3, the fixed antenna design of FIG. 7, or the top-loaded design of FIG. 8, the connector design 16 is substantially similar in each of those designs. In the embodiment of FIG. 8, the connector 16 does not have an upper end portion which supports the helical antenna, since the helical antenna is positioned at the upper end of the rod antenna.

Thus it can be seen that a novel antenna design has been employed which includes a snap-in connector so that the antenna may be quickly and easily secured to the housing or removed therefrom. The design of this invention ensures that the proper electrical contact will be made inasmuch as the connector 16 can only be inserted into the housing in one position, with that one position ensuring that the spring contact 56 will be properly positioned with respect to the electrical contact pad 58.

The snap-in connector of this invention, as well as the antenna embodiments associated therewith, results in an antenna requiring less components without sacrificing reliability performance. The snap-in connector of this invention results in reduced manufacturing costs.

Thus it can be seen that the invention accomplishes at least all of its stated objectives.

We claim:

1. An antenna for a wireless communications device including receiving and transmitting circuitry within a housing having an opening at the upper end thereof, comprising:

a thermoplastic snap-in connector having upper and lower ends with a central bore extending therethrough;

said lower end of said connector being selectively removably snapped-in the opening of the housing;

a helical antenna positioned in said connector at the upper end thereof;

a coil cover extending around said helical antenna;

and a spring contact mounted in said snap-in connector;

said spring contact having upper and lower ends;

said spring contact being operatively electrically connected at its said upper end to said helical antenna and extending therefrom;

said spring contact having a protruding portion protruding from said snap-in connector;

the protruding portion of said spring contact being in electrical contact with the receiving and transmitting circuitry.

2. The antenna of claim 1 wherein the receiving and transmitting circuitry includes an electrical contact pad and wherein said spring contact is in electrical contact with the electrical contact pad.

3. The antenna of claim 1 wherein the opening in the housing includes an alignment keyway and wherein said connector includes an alignment key structure which is received by the alignment keyway to properly position said spring contact with respect to the receiving and transmitting circuitry.

4. The antenna of claim 2 wherein the opening in the housing includes an alignment keyway and wherein said connector includes an alignment key structure which is received by the alignment keyway to properly position said spring contact with respect to the electrical contact pad.

5. The antenna of claim 1 wherein said lower end of said connector includes a resilient latch for selectively retaining said connector in the opening of the housing.

6. An antenna for a wireless communications device including receiving and transmitting circuitry within a housing having an opening at the upper end thereof, comprising:

a thermoplastic snap-in connector having upper and lower ends with a central bore extending therethrough;

said lower end of said connector being selectively removably snapped-in the opening of the housing;

a helical antenna positioned in said central bore of said connector and having a contact leg extending downwardly therefrom through said lower end of said connector;

said contact leg being in electrical contact with the receiving and transmitting circuitry.

7. The antenna of claim 6 wherein the receiving and transmitting circuitry includes an electrical contact pad and wherein said contact leg is in electrical contact with the electrical contact pad.

8. The antenna of claim 6 wherein the opening in the housing includes an alignment keyway and wherein said connector includes an alignment key structure which is received by the alignment keyway to properly position said contact leg with respect to the receiving and transmitting circuitry.

9. The antenna of claim 6 wherein said lower end of said connector includes a resilient latch for selectively retaining said connector in the opening of the housing.

10. An antenna for a wireless communications device including receiving and transmitting circuitry within a housing having an opening at the upper end thereof, comprising:

a thermoplastic snap-in connector having upper and lower ends with a central bore extending therethrough;

said lower end of said connector being selectively removably snapped-in the opening of the housing;

a helical antenna positioned in said central bore of said connector and having upper and lower ends;

an elongated rod antenna electrically connected to the upper end of said helical antenna and extending upwardly therefrom;

an antenna cover extending around said helical antenna and said rod antenna;

and a spring contact positioned in said snap-in connector and being operatively electrically connected to said helical antenna;

said spring contact having a protruding portion which protrudes from said snap-in connector;

said protruding portion of said spring contact being in electrical contact with the receiving and transmitting circuitry.

11. The antenna of claim 10 wherein said spring contact is integrally formed with said helical antenna.

12. The antenna of claim 11 wherein the opening in the housing includes an alignment keyway and wherein said connector includes an alignment key structure which is received by the alignment keyway to properly position said spring contact with respect to the receiving and transmitting circuitry.

13. An antenna for a wireless communications device including receiving and transmitting circuitry within a housing having an opening at the upper end thereof, comprising:

a thermoplastic snap-in connector having upper and lower ends with a central bore extending therethrough;

said lower end of said connector being selectively removably snapped-in the opening of the housing;

an elongated retractable rod antenna, having upper and lower ends, selectively slidably mounted in said connector and being movable between extended and retracted positions;

a helical antenna at the upper end of said rod antenna;

an electrically conductive spring contact positioned in said snap in connector and having a portion which is in electrical contact with the receiving and transmitting circuitry.

14. The antenna of claim 13 wherein the receiving and transmitting circuitry includes an electrical contact pad and wherein said spring contact is in electrical contact with the electrical contact pad.

15. The antenna of claim 13 wherein the opening in the housing includes an alignment keyway and wherein said connector includes an alignment key structure which is received by the alignment keyway to properly position said spring contact with respect to the receiving and transmitting circuitry.

16. The antenna of claim 13 wherein said spring contact yieldably engages said elongated rod antenna, when said rod antenna is in its extended position, to yieldably maintain said rod antenna in its said extended position.

17. An antenna for a wireless communications device including receiving and transmitting circuitry within a housing having an opening at the upper end thereof, comprising:

a thermoplastic snap-in connector having upper and lower ends with a central bore extending therethrough;

said lower end of said connector being selectively removably snapped-in the opening of the housing;

a helical antenna positioned in said connector at the upper end thereof;

a coil cover extending around said helical antenna;

a spring contact secured to said snap-in connector, having upper and lower ends, operatively electrically connected to said helical antenna which extends downwardly from said helical antenna;

said spring contact being in electrical contact with the receiving and transmitting circuitry;

an elongated retractable rod antenna, having upper and lower ends, selectively slidably mounted in said connector and being movable between extended and retracted positions;

said spring contact being in electrical contact with said rod antenna when said rod antenna is in its said extended position.

18. The antenna of claim 17 wherein said spring contact yieldably engages said elongated rod antenna, when said rod antenna is in its extended position, to yieldably maintain said rod antenna in its said extended position.

19. The antenna of claim 17 wherein the receiving and transmitting circuitry includes an electrical contact pad and wherein said spring contact is in electrical contact with the electrical contact pad.

20. The antenna of claim 17 wherein the opening in the housing includes an alignment keyway and wherein said connector includes an alignment key structure which is received by the alignment keyway to properly position said spring contact with respect to the receiving and transmitting circuitry.

21. The antenna of claim 17 wherein said lower end of said connector includes a resilient latch for selectively retaining said connector in the opening of the housing.

* * * * *